United States Patent [19]

Katzman et al.

[11] 4,245,429

[45] Jan. 20, 1981

[54] BABY DOLL

[75] Inventors: Allison W. Katzman; Edward T. Holahan, both of Chicago; Harry Disko, South Barrington, all of Ill.

[73] Assignee: Marvin Glass & Associates, Chicago, Ill.

[21] Appl. No.: 117,812

[22] Filed: Feb. 1, 1980

[51] Int. Cl.[3] ..... A63H 29/12; A63H 3/48

[52] U.S. Cl. ..... 46/164; 46/41; 46/162

[58] Field of Search ..... 46/41, 162, 164, 151

[56] References Cited

U.S. PATENT DOCUMENTS

| | | | |
|---|---|---|---|
| 2,504,653 | 4/1950 | Cohn | 46/162 X |
| 2,931,136 | 4/1960 | Loewy | 46/164 X |
| 3,465,474 | 9/1969 | Gardel et al. | 46/164 X |
| 3,757,460 | 9/1973 | Morrison | 46/41 |
| 3,911,617 | 10/1975 | Gelfand | 46/151 |
| 3,977,121 | 8/1976 | Goldfarb | 46/151 |
| 3,990,175 | 11/1976 | Conway et al. | 46/164 X |

FOREIGN PATENT DOCUMENTS

| | | | |
|---|---|---|---|
| 1540077 | 2/1979 | United Kingdom | 46/162 |

*Primary Examiner*—F. Barry Shay

*Attorney, Agent, or Firm*—Mason, Kolehmainen, Rathburn & Wyss

[57] ABSTRACT

A doll having the appearance and physical characteristics of a new born baby includes a hollow body and head interconnected at the neck and a hollow sealed bladder is mounted in the head having a smaller volume and a flexible wall portion secured to an inside surface. The hollow bladder is filled with a plurality of discrete, particles such as sand grains or beans flowable and movable freely about within the bladder to change the shape and change the center of gravity of the doll's head when the body or head is moved. Similarly, another body bladder is mounted in the hollow body with a volume somewhat less than the volume of the body and this bladder is formed with a flexible wall and filled with similar discrete, flowable particles so that the center of gravity of the doll's body is changed as the body or head is moved. Thus, the doll of the present invention feels and handles like a real-life, young baby.

12 Claims, 3 Drawing Figures

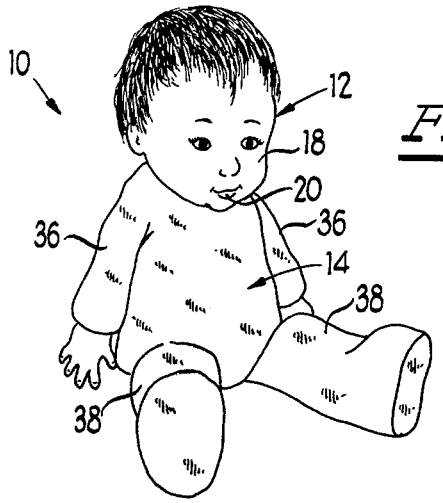
Fig 1
Fig 2
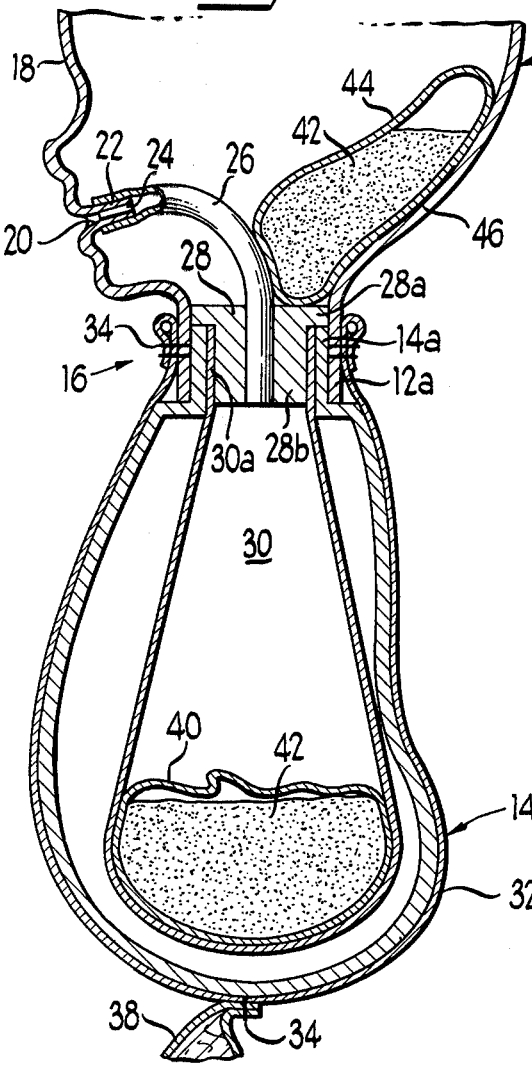
Fig 3
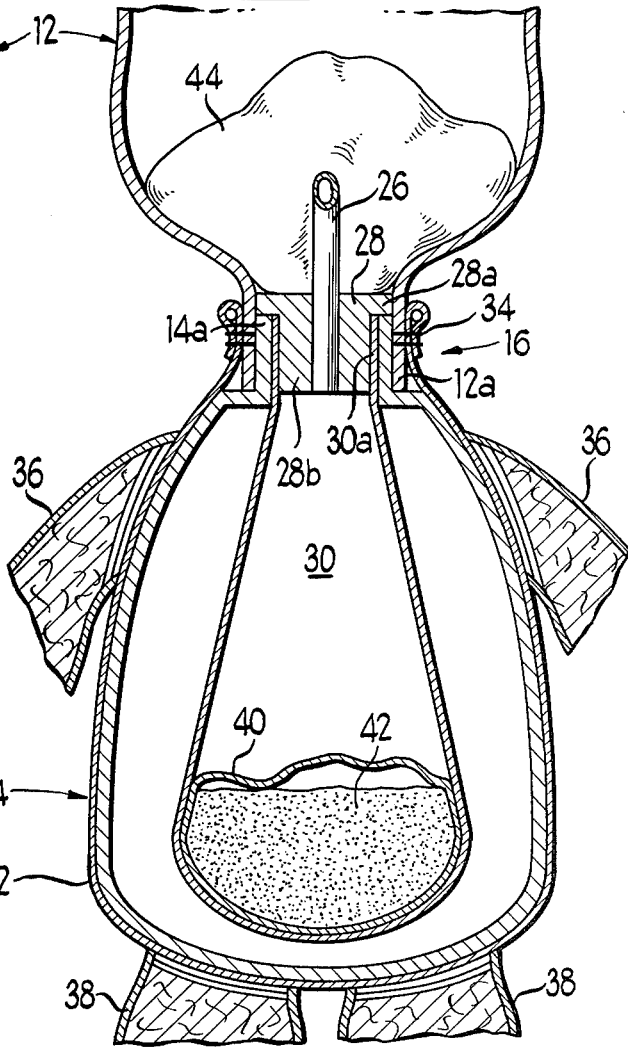

BABY DOLL

BACKGROUND OF THE INVENTION

1. Field of the Invention

The present invention relates to a baby doll and more particularly, to a baby doll having the appearance and physical characteristics of a young baby.

2. Description of the Prior Art

A wide variety of dolls, baby dolls and animated dolls of various types have been provided over the years and almost every type and kind of real life action has been simulated such as walking, talking, crying, etc. As far as is known, however, no dolls have been provided wherein the real life characteristics of a new born baby such as physical handling and appearance have been closely simulated. For example, young or new born babies have relatively weak backs and necks and their heads tend to flop toward the rear or on one side if not properly supported when the child is handled. Similarly, abdominal muscles and the spine of a young child are not well developed and internal organs of the body may move about more freely when the body position is changed than in older children.

OBJECTS OF THE PRESENT INVENTION

Accordingly, it is an object of the present invention to provide a new and improved baby doll which closely simulates the appearance and physical characteristics of a new born baby or infant.

Another object of the present invention is to provide a new and improved baby doll of the character described which feels like a real life, new born infant when handled or picked up.

Yet another object of the present invention is to provide a new and improved baby doll of the character described which has a head which tends to flop easily to the back or one side when the doll is moved and the head is not supported, thus closely simulating the body handling characteristics of a new born infant.

Still another object of the present invention is to provide a new and improved baby doll of the character described wherein the center of gravity of the doll's head is readily changeable on movement of the doll's head or body.

Yet another object of the present invention is to provide a new and improved baby doll of the character described wherein the center of gravity of the doll's abdomen or trunk is readily changed as the doll's head or body are moved.

Still another object of the present invention is to provide a new and improved baby doll of the character described which produces and emits a sound as the doll's head or body is moved.

Yet another object of the present invention is to provide a new and improved baby doll of the character described which closely simulates in appearance and physical characteristics a real life, new born infant.

SUMMARY OF THE INVENTION

The foregoing and other objects and advantages of the present invention are accomplished in a new and improved baby doll of the character described which has a hollow body and head interconnected at the neck. A hollow, sealed, head bladder having a volume less than the doll's head is mounted in the hollow head and includes a closed, flexible wall with a portion thereof secured to an inside surface of the doll's head. Filler material such as sand grains or beans are provided in the bladder for changing the shape thereof and thus, the center of gravity of the doll's head in response to movement of the doll's body or head. The doll also includes a similar, hollow, sealed internal body bladder having a volume less than that of the doll's abdomen or body and filled with similar materials such as beans or sand grains so that the center of gravity of the doll's body or trunk is readily changed when the head or body is moved. A pneumatic sound generator is mounted in the doll's head and a fluid conduit is connected therewith for moving fluid to and from the generator whenever the bladders in the head or body are moved or change in shape.

BRIEF DESCRIPTION OF THE DRAWINGS

For a better understanding of the invention, reference should be had to the following detailed description taken in conjunction with the drawings, in which:

FIG. 1 is a front perspective view of a baby doll constructed in accordance with the features of the present invention and shown in an upright sitting position;

FIG. 2 is a longitudinal, cross-sectional view through the doll's head and body; and FIG. 3 is a longitudinal cross-sectional view taken on a plane generally normal to the sectional plane of FIG. 2.

DESCRIPTION OF THE PREFERRED EMBODIMENT

Referring now more particularly to the drawings, therein is illustrated a new and improved baby doll 10 constructed in accordance with the features of the present invention and which is adapted to closely simulate the appearance and physical handling characteristics of a new born infant. The baby doll 10 includes a hollow head 12 and a hollow body 14 or abdomen joined together at a generally cylindrical neck portion 16 as shown in FIGS. 2 and 3. The doll's head is preferably formed with a thin wall of flexible molded plastic material and is shaped to include a face 18 on the front side having the usual facial features of a new born infant including a mouth 20. At the mouth there is provided an inwardly extending tubular sleeve 22 in communication with the interior of the doll's head.

A sound generator 24 in the form of a two way pneumatic vibrating reed assembly is mounted in the sleeve 22 so that air flowing into or out of the interior of the doll will cause a soft baby-like sound to be generated by the vibration of the reed(s) to simulate the soft cry of a new born or young baby. A fluid conduit of thin flexible tubing 26 is interconnected to an inner end portion of the sleeve 22 and is curved downwardly and extends through a central aperture in a cylindrical neck plug or base 28 positioned between the doll's head and the abdomen or body.

The neck plug includes an upper annular flange **28*a* having a diameter larger than that of a lower, downwardly depending segment 28*b* and the outer diameter of the upper flange is approximately equal to the internal diameter of a downwardly extending neck portion 12*a* formed on the doll's head. The lower segment of the neck plug 28*b* has an outer diameter substantially the same as the internal diameter of an upper end portion 30*a* of an internal body bladder 30 formed of thin flexible plastic material and having a volume somewhat less than the internal volume of the doll's body or abdomen. The collar or neck portion 30***a* of the bladder 30 is cemented or otherwise sealingly secured to the surface of the neck portion 28*b* to provide a fluid tight joint so that fluid within the bladder 30 will flow into or out of the conduit 26 without leakage around the neck plug.

The body or abdomen 14 of the doll is formed of thin, flexible, foam plastic material and is provided with a cylindrical upper neck portion or collar 14*a* surrounding the neck portion 30*a* of the internal body bladder 30. The body includes an outer cover or skin 32 of cloth or fabric used to cover the outer wall of the body and the skin is stitched in place around the neck or collar by suitable stitching 34 as shown.

A pair of arms 36 also having an outer skin of fabric and stuffed with cotton or other filler material is attached to an upper portion of the body skin 32 by stitching or other suitable means and similarly, a pair of legs 38 also having an outer skin of fabric and filled with cotton or other filler material are stitched to the lower end portion of the main body skin 32 as shown in FIG. 2.

In accordance with the present invention, the body bladder 30 provides a pendulum-like support for a smaller, internal, second body bladder 40 in the form of a "bean bag" or the like having a hollow sealed wall of thin, flexible, plastic material and containing a quantity of small sized, flowable elements of a particulate nature such as sand grains, dried beans, small plastic spheres or the like and generally referred to by the reference numeral 42.

The volume of the inner sealed hollow bladder 40 is substantially less than that of the supporting bladder 30 so that as the inner bladder is moved and the shape thereof is changed the air or fluid space above or around the inner bladder is readily changeable to force fluid upwardly into the conduit 26 or to draw fluid therefrom thereby activating the sound generator reed mechanism 24 whenever substantial movement or change of shape of the internal body bladders 30 or 40 occurs due to movement of the doll or doll's body.

When the doll's body is moved, the internal bladder 40 and the flowable, particulate, filler material 42 contained therein, are readily movable so that the overall center of gravity of the doll's body or trunk is changed and this change provides a feel when handling the doll that is closely similar to the feel encountered when handling a real life, new born, infant or small baby. In addition to the feel or physical handling characteristics provided, movement of air through the conduit 26 that is caused by a movement or change of shape of the body bladders 30 and 40 also generates a soft sound such as the "crying out" of a young infant.

In accordance with the present invention, the doll is provided with a head bladder 44 which has a closed, hollow wall formed of thin, flexible, plastic material and a volume substantially less than the internal volume of the doll's head. The head bladder 44 is filled with smaller, flowable, particulate filler material 42 and the bladder is readily changeable in shape or volume upon movement of the doll's body or head. This movement readily changes the center of gravity of the doll's head and closely simulates the floppiness of a young child's head to the rear or side as occurs in real life when a child is being handled without proper support for the head. The head bladder 44 includes a rear wall portion 46 which is secured by suitable means such as adhesive material to a back wall portion of the doll's head 12 rearwardly of the fluid conduit 26. Only a relatively small portion of the wall surface of the head bladder is positively secured to the inside surface of the doll's head and the remaining portions of the wall of the bladder are free to move along with the movement of the flowable filler material contained therein as the doll's head position is changed.

It should be noted that the bladder 44 is positioned generally to the rear of the doll's head so that the head does tend to flop backwardly or to either side in a manner similar to that encountered when handling a new born baby in real life. A forward portion of the head bladder 44 is adapted to press against and engage the fluid conduit 26 and accordingly, this action may cause fluid in the conduit to move toward or away from the sound generating, two way, reed mechanism 24 to produce a soft crying sound. Because the head bladder 44 acts only with external physical force or pressure on the fluid conduit 26, the air flow in the conduit is only gradually effected by increasing or decreasing bladder pressure and accordingly, the sound generated by the reed mechanism 24 in response to movement of the head bladder 44 is relatively low in comparison with the sound that may be generated by the larger, lower body bladders 30 and 40 which are in fluid communication with the conduit 26. Thus, it will be seen that the baby doll 10 constructed in accordance with the features of the present invention closely simulates the appearance and physical handling characteristics of a new born infant and particularly, provides an accurate "real life" feel for a person handling and playing with the doll.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A baby doll comprising:

a hollow body and a hollow head interconnected at a neck;

a hollow, sealed, head bladder in said hollow head having a volume less than said head and having a closed flexible wall with only a small portion of the wall secured to an inside surface of said head; and filler means in said bladder comprising a plurality of discrete particles contained and movable within said bladder for changing the shape thereof to enable changing the center of gravity of said head when said body or head is moved.

2. The baby doll of claim 1 including:

a hollow, sealed, internal body bladder in said hollow body having a volume less than said body and a closed flexible wall, and filler means in said body bladder comprising a plurality of discrete particles contained and movable therein for changing the center of gravity of said body when said body or head is moved.

3. The baby doll of claim 1 or 2 wherein said head bladder wall portion is secured to an inside surface on a back portion of said head.

4. The baby doll of claim 1 or 2 wherein said head includes a face with a mouth opening therein and a pneumatic sound generator in said head adjacent said mouth opening adapted to activation by movement of said head bladder to generate sound.

5. The baby doll of claim 4 wherein said sound generator includes a vibrating reed and a fluid conduit in said head in communication with said reed positioned for engagement by movement of said head bladder to move fluid to or from said reed to generate sound.

6. The baby doll of claim 2 wherein said head includes a face with a mouth opening therein and a pneumatic sound generator adapted for activation by movement of said body bladder to generate sound.

7. The baby doll of claim 6 wherein said sound generator includes a vibrating reed and a conduit in communication with said reed and with means within said body for activation by movement of said body bladder to move fluid to or from said reed to generate sound.

8. The baby doll of claim 7 said means within said body including a second body bladder in said body having a volume greater than said first mentioned body bladder for containing the same, said conduit being in communication with said second body bladder through said neck whereby movement of said first mentioned body bladder inside said second body bladder is effective to move fluid in said conduit to generate sound.

9. The baby doll of claim 8 wherein said second body bladder includes a thin flexible wall secured at an upper end to said neck.

10. The baby doll of claim 9 wherein said second body bladder has a volume smaller than said body for permitting swinging movement within said body from said upper end portion secured to said neck.

11. The baby doll of claim 7 wherein said head bladder is engageable with said conduit for moving fluid therein to generate sound in response to movement of said head.

12. The baby doll of claim 11 wherein said head bladder includes a wall portion secured to a back wall of said head and includes a forward wall portion movably engageable with said fluid conduit.

* * * * *